US005651203A

United States Patent [19]

Knight

[11] Patent Number: 5,651,203

[45] **Date of Patent: *Jul. 29, 1997**

[54] BREECH PLUG AND IGNITION SYSTEM FOR MUZZLE-LOADING FIREARM

[75] Inventor: William A. Knight, Plano, Iowa

[73] Assignee: Modern Muzzleloading, Inc., Centerville, Iowa

[ * ] Notice: The term of this patent shall not extend beyond the expiration date of Pat. No. 5,561,934.

[21] Appl. No.: 602,919

[22] Filed: Feb. 16, 1996

Related U.S. Application Data

[63] Continuation of Ser. No. 343,622, Nov. 23, 1994, Pat. No. 5,561,934.

[51] Int. Cl.[6] ..... F41B 15/10

[52] U.S. Cl. ..... 42/25; 89/27.13

[58] Field of Search ..... 89/27.13, 1.3; 42/51, 25

[56] References Cited

U.S. PATENT DOCUMENTS

| | | | |
|---|---|---|---|
| 417,693 | 12/1889 | Wiegand | 89/27.13 |
| 476,290 | 6/1892 | Mauser | 42/25 |
| 1,850,034 | 3/1932 | Samaia | 89/1.3 |
| 2,765,560 | 10/1956 | Linder | 42/25 |
| 3,780,464 | 12/1973 | Anderson | 42/51 |
| 4,437,249 | 3/1984 | Brown et al. | 42/51 |
| 4,478,128 | 10/1984 | Black et al. | 102/440 |
| 4,860,632 | 8/1989 | Bruderer et al. | 89/33.25 |
| 5,109,622 | 5/1992 | Echeberria | 42/51 |
| 5,133,143 | 7/1992 | Knight | 42/51 |
| 5,307,583 | 5/1994 | Mahn et al. | 42/51 |
| 5,408,776 | 4/1995 | Mahn et al. | 42/51 |

FOREIGN PATENT DOCUMENTS

| | | | |
|---|---|---|---|
| 584454 | 2/1925 | France | 89/1.3 |
| 1293363 | 4/1962 | France | 89/1.3 |

*Primary Examiner*—Stephen M. Johnson
*Attorney, Agent, or Firm*—Zarley, McKee, Thomte, Voorhees, & Sease

[57] ABSTRACT

A breech plug and igniter system for a muzzle-loading rifle includes a generally cylindrical breech plug with a cylindrical chamber formed in the rearward end coaxial with the plug, and an ignition bore extending forwardly through the plug from the forward end of the chamber. A percussion capsule has a forward end removably mounted within the chamber and a rearward end projecting rearwardly from the rearward end of the breech plug. The percussion capsule has a metal percussion cup mounted in the rearward end of the capsule with the cup base flush with the base of the capsule. The percussion cup has an open forward end communicating with a bore in the capsule, which communicates with the ignition bore of the breech plug. The rearward end of the capsule has an annular lip projecting radially outwardly around the circumference thereof. A bolt has a slot formed in the side wall thereof spaced slightly rearwardly from the forward end of the bolt for receiving the rearward end of the percussion capsule. An opening in the forward wall of the slot has a width to receive the exterior diameter of the capsule, while the slot has a width to receive the annular lip, such that the bolt will removably receive the capsule rearward end within the slot to insert and remove the capsule from the breech plug chamber.

2 Claims, 1 Drawing Sheet

BREECH PLUG AND IGNITION SYSTEM FOR MUZZLE-LOADING FIREARM

This is a continuation of application Ser. No. 08/343,622 filed on Nov. 23, 1994 now U.S. Pat. No. 5,561,934.

TECHNICAL FIELD

The present invention relates generally to muzzle-loading rifles, and more particularly to an improved breech plug with a chamber for receiving a portion of a plastic percussion capsule and a bolt having a specially designed slot for removable connection to the capsule, forming an improved ignition system.

BACKGROUND OF THE INVENTION

The conventional muzzle-loading rifle includes a barrel which extends forwardly from a receiver, the rearward end of the barrel having a breech which receives propellant and a projectile through the muzzle. A breech plug is threadably mounted in the receiver and seals the rearward end of the barrel, in the breech, to prevent blow back of gases upon ignition of the propellant within the breech.

In all percussion muzzle-loaders, a nipple is mounted in the rear end of the breech plug with a projecting rearward end adapted to receive a percussion cap thereon. When struck by a hammer, the percussion cap is fired and ignition sparks travel through a central bore the length of the nipple to ignite the propellant in the breech.

One problem with conventional nipples is that they provide a poor seal between the percussion cap and the nipple because conventionally the cap is formed of copper and the nipple is formed of steel. The cap splits when fired, allowing blow-by of gases from the firearm and permitting the discharge of residue into the receiver and around the bolt firing pin and hammer.

Another problem with blow-by gas in conventional breech plugs with nipples is the possibility of percussion cap particles being discharged out of the receiver and into the face of the shooter.

The use of a cap on the rearward end of a nipple to provide the primer for the ignition system requires effective seating of the cap on the nipple, which can be difficult, and cause misfiring if not accurate.

SUMMARY OF THE INVENTION

It is therefore a general object of the present invention to provide an improved breech plug for a muzzle-loading rifle.

Another object of the present invention is to provide an improved breech plug which will receive a special percussion capsule which eliminates the need for conventional nipples and percussion caps.

Yet another object of the present invention is to provide an improved ignition system for a muzzle-loading rifle which prevents blow-back of gases during ignition and discharge of the firearm.

Still another object is to provide an ignition system for a muzzle-loading rifle with a bolt which engages a portion of the percussion capsule to add strength to the capsule and permit easy extraction of the capsule from the breech plug.

These and other objects will be apparent to those skilled in the art.

The breech plug and igniter system for a muzzle-loading rifle of the present invention includes a generally cylindrical breech plug with a cylindrical chamber formed in the rearward end coaxial with the plug, and an ignition bore extending forwardly through the plug from the forward end of the chamber. A metal or plastic percussion capsule has a forward end removably mounted within the chamber and a rearward end projecting rearwardly from the rearward end of the breech plug. The percussion capsule has a metal percussion cup mounted in the rearward end of the capsule with the cup base flush with the base of the capsule. The percussion cup has an open forward end communicating with a bore in the capsule, which communicates with the ignition bore of the breech plug. The rearward end of the capsule has an annular lip projecting radially outwardly around the circumference thereof. A bolt has a slot formed in the side wall thereof spaced slightly rearwardly from the forward end of the bolt for receiving the rearward end of the percussion capsule. An opening in the forward wall of the slot has a width to receive the exterior diameter of the capsule, while the slot has a width to receive the annular lip, such that the bolt will removably receive the capsule rearward end within the slot to insert and remove the capsule from the breech plug chamber.

DESCRIPTION OF THE PREFERRED EMBODIMENT

Figures 1, 2, 3, 4, 5:
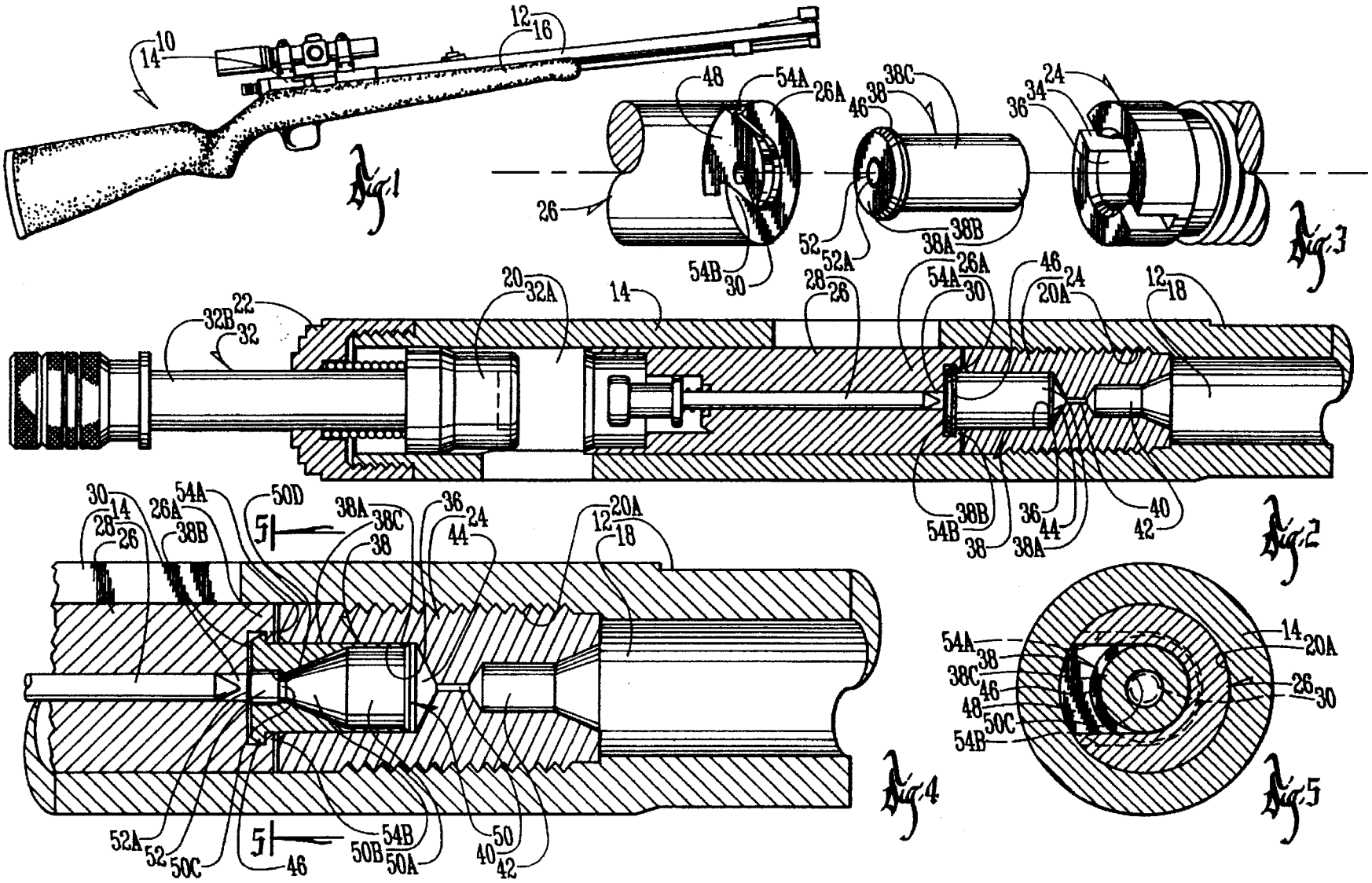
FIG. 1 is a side elevational view of a muzzle-loading rifle which incorporates the breech plug and ignition system of the present invention.
FIG. 2 is a sectional view through the receiver of the rifle of FIG. 1, showing the breech plug and ignition system of the present invention.
FIG. 3 is an exploded perspective view of a portion of the breech plug, the percussion capsule, and a portion of the bolt, of the present invention.
FIG. 4 is an enlarged view of a portion of the section of FIG. 2, showing the components of FIG. 3 in sectional view.
FIG. 5 is a sectional view taken at lines 5—5 in FIG. 4.

Referring now to the drawings, in which similar or corresponding parts are identified with the same reference numeral, and more particularly to FIG. 1, a muzzle-loading rifle is designated generally at 10 and includes a barrel 12 extending forwardly from a forward end of a receiver 14, which is mounted on a gun stock 16.

As shown in FIG. 2, the numeral 18 refers generally to the breech, which is located at the rearward end of barrel 12 and designed to receive the propellant and a projectile.

Receiver 14 includes an axial bore 20 therein having a forward end communicating with breech 18 and a rearward end enclosed by an end cap 22. The forward end 20*a* of receiver bore 20 is internally threaded to receive breech plug 24 therein. A bolt 26 is slidably mounted within receiver bore 20 rearwardly of breech plug 24 and has a firing pin 28 slidably journaled through a centrally disposed axial aperture 30 from the rearward to the forward end of bolt 26. A hammer 32 includes a head 32*a* slidably journaled within receiver bore 20 rearwardly of bolt 26, and a shank 32*b* projecting rearwardly through an aperture in end cap 22. It can be seen that the projecting end of hammer shank 32*b* thereby serves as a cocking handle for hammer 32.

Referring now to FIG. 4, breech plug 24 is exteriorly threaded to engage the interior threads 24*a* of the forward end of receiver bore 20 (see FIG. 2). The rearward end of breech plug 24 is provided with a notch 34 (see FIG. 3)

adapted to receive a tool for rotating the plug and inserting or removing the plug from receiver 14. A generally cylindrical chamber 36 is formed in the rearward end of breech plug 24, as shown in FIG. 3, to receive a special percussion capsule 38 therein. Chamber 36 extends axially forwardly within breech plug 24 and communicates with a small diameter cylindrical ignition bore 40 coaxial with chamber 36. Ignition bore 40 extends forwardly and communicates with a forward ignition bore 42 having a larger diameter than rearward ignition bore 40, but a smaller diameter than chamber 36. The forward end of forward ignition bore 42 expands in diameter to form a funnel shape communicating with breech 18. A funnel portion 44 communicates between chamber 36 and rearward ignition bore 40 to taper the reduction in diameter from chamber 36 to rearward ignition bore 40.

The percussion capsule 38 is preferably a plastic cylinder having a forward end 38*a* and rearward end 38*b*, as shown in FIG. 3. An annular lip 46 projects radially from the rearward end of percussion capsule 38, and engages a slot 48 formed in the forward end of bolt 26, as described in more detail hereinbelow.

Referring now to FIG. 4, percussion capsule 38 includes an interior bore 50 having a large diameter forward portion 50*a*, a funnel-shaped intermediate portion 50*b*, a small diameter intermediate portion 50*c*, and a rearward bore 50*d* which acts as a percussion cup pocket. A percussion cup 52 is mounted within rearward bore 50*d* of capsule 38 with its circular base 52*a* flush with the rearward end of capsule 38. Percussion cup 52 includes a charge of igniter material therein, as is well known in the art.

As shown in FIGS. 3 and 5, bolt 26 is a generally cylindrical steel member with a slot 48 extending radially inwardly through the bolt side wall, to encompass the firing pin aperture 30. Slot 48 has a width and depth to receive the annular lip 46 of percussion capsule 38 slidably therein. The side wall 54 separating slot 48 from bolt forward end 26*a*, has an opening formed therethrough, extending radially inwardly to encompass aperture 30, to form shoulders 54*a* and 54*b* on opposite sides of slot 48. Shoulders 54*a* and 54*b* are spaced apart a distance less than the diameter of the annular lip 46, such that the rearward end of capsule 38 is retained within slot 48 and moved longitudinally with bolt 26. As shown in FIG. 3, once capsule 38 is engaged within slot 48, percussion cup 52 will be aligned with aperture 30 and thus with firing pin 28.

In operation, hammer 32 is cocked and released so as to strike firing pin 28 and cause it to strike the base of percussion cup 52, as shown in FIG. 2. This in turn ignites the charge within percussion cup 52, producing sparks and expanding gases which pass through capsule intermediate bore 50*b*, (see FIG. 4), capsule forward bore 50*a*, funnel portion 44 of breech plug 24, rearward ignition bore 40, and forward ignition bore 42 to reach breech 18. It can be seen that the expanding gases within intermediate and forward bores 50*b* and 50*a* of capsule 38 will cause an outwardly radially directed force to expand the side wall 38*c* of percussion capsule 38 forming a tight seal within chamber 36 of breech plug 24 and preventing blow-back of the gases and residue from the breech plug. Similarly, the back discharge from the ignition of the propellant in breech 18 will also cause the capsule side wall 38*c* to expand outwardly and seal against back pressure.

Because the percussion cup 52 is permanently seated within rearward bore 50*c* of capsule 38, there is no possibility of misaligning the percussion cup so as to cause a misfiring. In addition, the engagement of annular lip 46 in the rearward end of capsule 38 within slot 48 adds strength to the plastic casing of capsule 38 to eliminate pressure rupture. Slot 48 also permits ease of seating and extraction of capsule 38 from breech plug 24 without special tools.

Whereas the invention has been shown and described in connection with the preferred embodiment thereof, it should be understood that many modifications, substitutions and additions may be made which are within the intended broad scope of the appended claims.

I claim:

1. A bolt for a firearm, comprising, a cylindrical-shaped member of integral one piece construction having a center axis, an outer surface and a forward end, a firing pin bore on said center axis extending to said forward end, a U-shaped slot in said member adjacent said forward end and extending radially inwardly from said outer surface towards and beyond said center axis; said slot having a continuous outer perimeter comprised of substantially parallel sides connected at their inner ends by an arcuate portion, and a continuous peripheral U-shaped wall extending completely around the outer perimeter of said U-shaped slot.

2. The device of claim 1 wherein said peripheral U-shaped wall has a breadth less than that of said U-shaped slot.

* * * * *